US009316231B2

(12) United States Patent
Simms

(10) Patent No.: US 9,316,231 B2
(45) Date of Patent: Apr. 19, 2016

(54) CATCHER RING ASSEMBLY

(75) Inventor: Paul Simms, Leicester (GB)

(73) Assignee: ROLLS-ROYCE plc, London (GB)

( * ) Notice: Subject to any disclaimer, the term of this patent is extended or adjusted under 35 U.S.C. 154(b) by 820 days.

(21) Appl. No.: 13/584,260

(22) Filed: Aug. 13, 2012

(65) Prior Publication Data

US 2013/0058775 A1 Mar. 7, 2013

(30) Foreign Application Priority Data

Sep. 2, 2011 (GB) ..... 1115139.6

(51) Int. Cl.
*F04D 29/043* (2006.01)
*F01D 21/04* (2006.01)
*F04D 27/02* (2006.01)

(52) U.S. Cl.
CPC ..... *F04D 29/043* (2013.01); *F01D 21/045* (2013.01); *F04D 27/0292* (2013.01)

(58) Field of Classification Search
CPC ... F04D 27/0292; F04D 29/043; F01D 21/00; F01D 21/04; F01D 21/045; F05B 2260/30; F05D 2260/31; F05D 2260/311
See application file for complete search history.

(56) References Cited

U.S. PATENT DOCUMENTS

2005/0172608 A1 8/2005 Lapergue et al.
2005/0241290 A1* 11/2005 Lapergue et al. ..... 60/226.1

OTHER PUBLICATIONS

British Search Report issued in British Application No. 1115139.6 dated Dec. 15, 2011.

* cited by examiner

*Primary Examiner* — Nathaniel Wiehe
*Assistant Examiner* — Jason Davis
(74) *Attorney, Agent, or Firm* — Oliff PLC

(57) ABSTRACT

A catcher ring assembly (170) configured to limit axial movement of a turbomachine shaft assembly (132, 132') during a failure mode, the catcher ring assembly comprising a catcher ring (172) disposable about and connectable to the shaft assembly, wherein one of the shaft assembly and the catcher ring comprises a protrusion (194, 182) and the other of the shaft assembly and the catcher ring comprises a recess (192, 184), the recess corresponding in shape to the protrusion, wherein the protrusion and recess are circumferentially disposed about a longitudinal axis of the shaft assembly and the protrusion extends in an axial direction.

10 Claims, 4 Drawing Sheets

CATCHER RING ASSEMBLY

The present disclosure relates to a catcher ring assembly and particularly but not exclusively relates to a catcher ring assembly for a ducted gas turbine shaft assembly.

BACKGROUND

Referring to FIG. 1, a ducted fan gas turbine engine (e.g. a jet engine) generally indicated at 10 has a principal and rotational axis 11. The engine 10 comprises, in axial flow series, an air intake 12, a propulsive fan 13, an intermediate pressure (IP) compressor 14, a high-pressure (HP) compressor 15, combustion equipment 16, a high pressure turbine 17, an intermediate pressure turbine 18, a low pressure (LP) turbine 19 and a core exhaust nozzle 20. A nacelle 21 generally surrounds the engine 10 and defines the intake 12, a bypass duct 22 and an exhaust nozzle 23.

The gas turbine engine 10 works in the conventional manner so that air entering the intake 11 is accelerated by the fan 13 to produce two air flows: a first airflow A into the intermediate pressure compressor 14 and a second airflow B which passes through the bypass duct 22 to provide propulsive thrust. The intermediate pressure compressor 14 compresses the airflow A directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive, the high, intermediate and low pressure turbines 17, 18, 19 before being exhausted through the nozzle 20 to provide additional propulsive thrust. The high, intermediate and low-pressure turbines 17, 18, 19 respectively drive the high and intermediate pressure compressors 15, 14 and the fan 13 by suitable interconnecting HP, IP and LP shafts 30, 31, 32.

As shown in FIG. 2, a front bearing housing assembly 40 for the LP shaft 32 on a previously-proposed aero-engine is located forward of the IP compressor 14. The front bearing housing assembly 40 comprises an LP shaft bearing mount system 50, LP phonic wheel 60 and LP shaft axial location bearing 52. The LP phonic wheel 60 provides a signal to the control system to monitor the rotation of the LP shaft 32.

Furthermore, the previously-proposed aero-engine comprises a fan catcher assembly 70 mounted to an LP stub-shaft 32' (which is rotatably linked to the LP shaft 32) in the front bearing housing assembly 40. The LP phonic wheel 60 is bolted to a fan catcher ring 72, via bolts 62, with the catcher ring 72 being part of the fan catcher assembly 70. The fan catcher ring 72 is in turn connected to the stub shaft 32' via a nut stack 74.

In the event of a fan-shaft failure or fan blade off event causing damage or failure to the fan-shaft, the fan-catcher assembly 70 is intended to arrest any forward movement of the fan-shaft by impacting on a rearwards end 54 of the LP stub-shaft bearing mount system 50. The resulting reaction load is taken through the LP bearing 50 to the front bearing housing structure 40.

As depicted, the phonic wheel 60 on the previously-proposed aero-engine is part of the fan catcher system 70. If any distortion or damage is caused to the phonic wheel it is important that the phonic wheel remains sufficiently intact that it may continue to provide a slowing down signal for at least approximately five engine revolutions or 200 ms after this event. Failure to provide at least a slowing down signal may mean that the control system ignores the loss of signal, instead assuming that the probe has simply failed. This is because the control system cannot differentiate the loss of signal from a probe failure or from a probe failure caused by a fan-shaft failure or fan blade off event. The control system may therefore continue to supply fuel to the combustion system and the turbine may continue to drive. Consequently, due to the fan shaft breaking and the resulting loss of inertia, there is a risk that the turbine may over-speed.

It is therefore desirable that the phonic wheel 60 remains intact and active to report a signal to the engine controller for a defined period of time after such a failure. Otherwise the controller does not recognise the fan shaft failure event, allowing continuation of fuel feed to the engine, which results in a potential turbine shaft over-speed.

As shown in FIG. 2, the phonic wheel 60 of the previously-proposed arrangement is clamped or bolted to the fan catcher ring assembly 70 (and hence LP stub shaft 32') by means of bolts and/or a locknut arrangement 62. However, upon impact the loads are sufficient to cause the fan catcher ring 72 to unload the clamping loads of the bolts and locknut 62 such that the fan catcher ring may pivot or bend back into the phonic wheel 60. Because the phonic wheel is not isolated from this distortion, this action may detach the phonic wheel from the catcher ring 72 and therefore prevent the speed signal from being maintained.

Furthermore, the fan catcher ring 72 is not supported in a way that adequately restricts precession or pivoting of the catcher ring relative to the stub shaft 32'. As the axial load is applied to the catcher ring 72 during a fan shaft failure, the clamp load on the catcher ring 72 is reduced and this may allow slippage on the axial face between the stub shaft 32' and the catcher ring 72. This prevents bending of the catcher ring 72 which helps to restrict the axial deflection of the ring. This high heeling deflection of the catcher ring 72 impacts directly on the phonic wheel mount, which in the previously-proposed arrangement is bolted directly to the catcher ring. These bolts 62 fail under such loading causing the phonic wheel 60 to become detached. However, simply removing the bolts 62 and fastening the phonic wheel 60 to the stub shaft 32' within the nut stack 74 will not stiffen up the catcher ring sufficiently to reduce the ring deflection, and so the phonic wheel will be destroyed as well. It is therefore desirable to reduce the axial deflection caused by the pivoting or heeling of the catcher ring within the nut stack.

The present disclosure therefore seeks to address these issues.

STATEMENTS OF INVENTION

According to a first aspect of the present invention there is provided a catcher ring assembly configured to limit axial movement of a turbomachine shaft assembly during a failure mode, the catcher ring assembly comprising a catcher ring disposable about and connectable to the shaft assembly, wherein one of the shaft assembly and the catcher ring comprises a protrusion and the other of the shaft assembly and the catcher ring comprises a recess, the recess corresponding in shape to the protrusion, wherein the protrusion and recess are circumferentially disposed about a longitudinal axis of the shaft assembly and the protrusion extends in an axial direction.

Both the catcher ring and the shaft assembly may comprise a protrusion. Both the catcher ring and shaft assembly may comprise a recess. The recess of the catcher ring may correspond in shape to the protrusion of the shaft assembly. The recess of the shaft assembly may correspond in shape to the protrusion of the catcher ring. The protrusions and recesses of both the catcher ring and shaft assembly may be circumferentially disposed about the longitudinal axis of the shaft assembly.

The catcher ring may comprise a hook portion adapted to connect to a corresponding hook portion provided on the shaft assembly. The hook portion of the catcher ring or shaft assembly may comprise the protrusion and/or recess.

The protrusion and recess may be axially aligned. For example, the protrusion may be orientated in the longitudinal direction. Accordingly, the recess, which may be configured to receive the protrusion may be orientated in the longitudinal direction.

The catcher ring assembly may comprise a spline or recess for engagement with a corresponding recess or spline provided on the shaft assembly respectively. The recess and spline may be configured to limit rotation of the catcher ring assembly relative to the shaft assembly.

The catcher ring assembly may further comprise a nut assembly. The nut assembly may comprise an intermediate element and a nut. The intermediate element may be provided between the nut and the catcher ring. The intermediate element may comprise the spline or recess for engagement with the corresponding recess or spline provided on the shaft assembly respectively. Alternatively, the catcher ring may comprise the spline or recess for engagement with the corresponding recess or spline provided on the shaft assembly respectively.

The catcher ring assembly may further comprise a locking member. The locking member may be disposable between the intermediate element and the catcher ring to limit rotation of the catcher ring with respect to the intermediate element.

A portion of the catcher ring may be securable between first and second abutment surfaces. The shaft assembly may comprise the first abutment surface. The nut assembly, for example the intermediate element or a further intermediate element, may comprise the second abutment surface.

The catcher ring may be disposed adjacent to a speed measuring device adapted to measure the rotational speed of the shaft assembly. At least a portion of the speed measuring device may be connected to the catcher ring assembly. For example, at least a portion of the speed measuring device may be connected to the catcher ring assembly via a nut assembly, e.g. the aforementioned nut assembly. The portion of the speed measuring device may be connected to the nut assembly through a further intermediate member provided between the nut and the catcher ring. Alternatively, at least a portion of the speed measuring device may be connected to the catcher ring directly. The speed measuring device may comprise a phonic wheel, a tachogenerator, a magnetic variable reluctance probe or any other speed measuring means.

The catcher ring may be adapted to abut a shoulder to limit axial movement of the shaft assembly during the failure mode.

A turbomachine may comprise the aforementioned catcher ring assembly. A fan assembly may comprise the aforementioned catcher ring assembly. A gas turbine engine may comprise the aforementioned catcher ring assembly.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
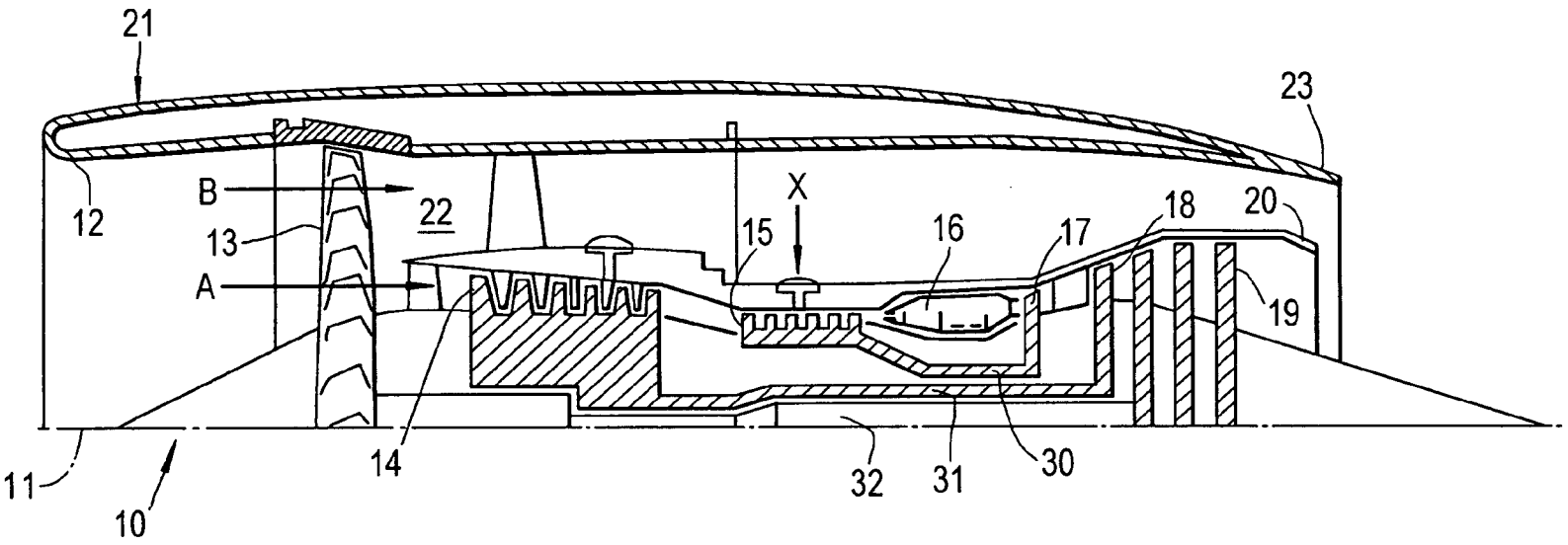
Fig.1 PRIOR ART
FIG. 1 is a schematic sectional view of a gas turbine engine.
Figure 2:
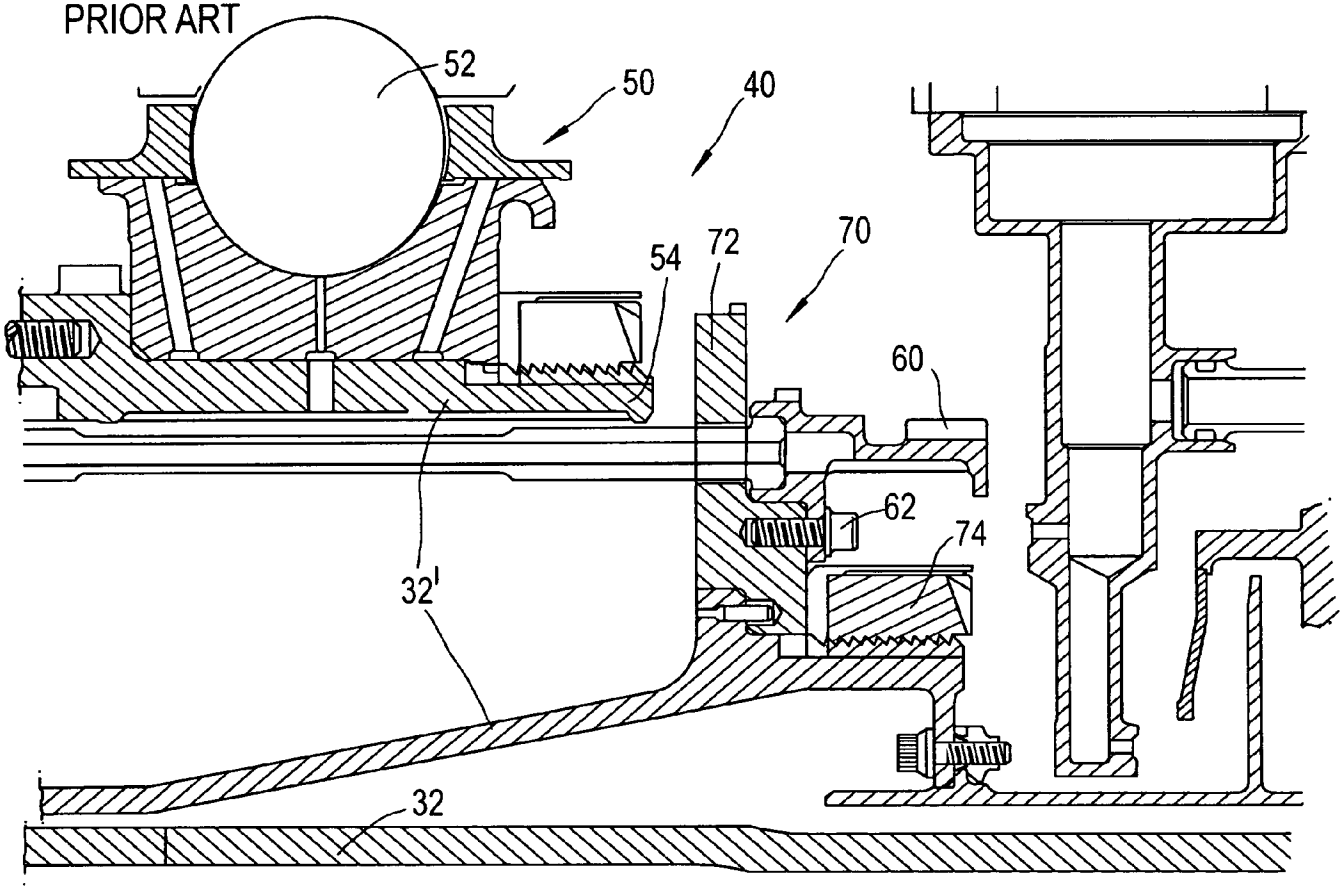
Fig.2 PRIOR ART
FIG. 2 depicts a previously-proposed front bearing housing assembly.
Figure 3:
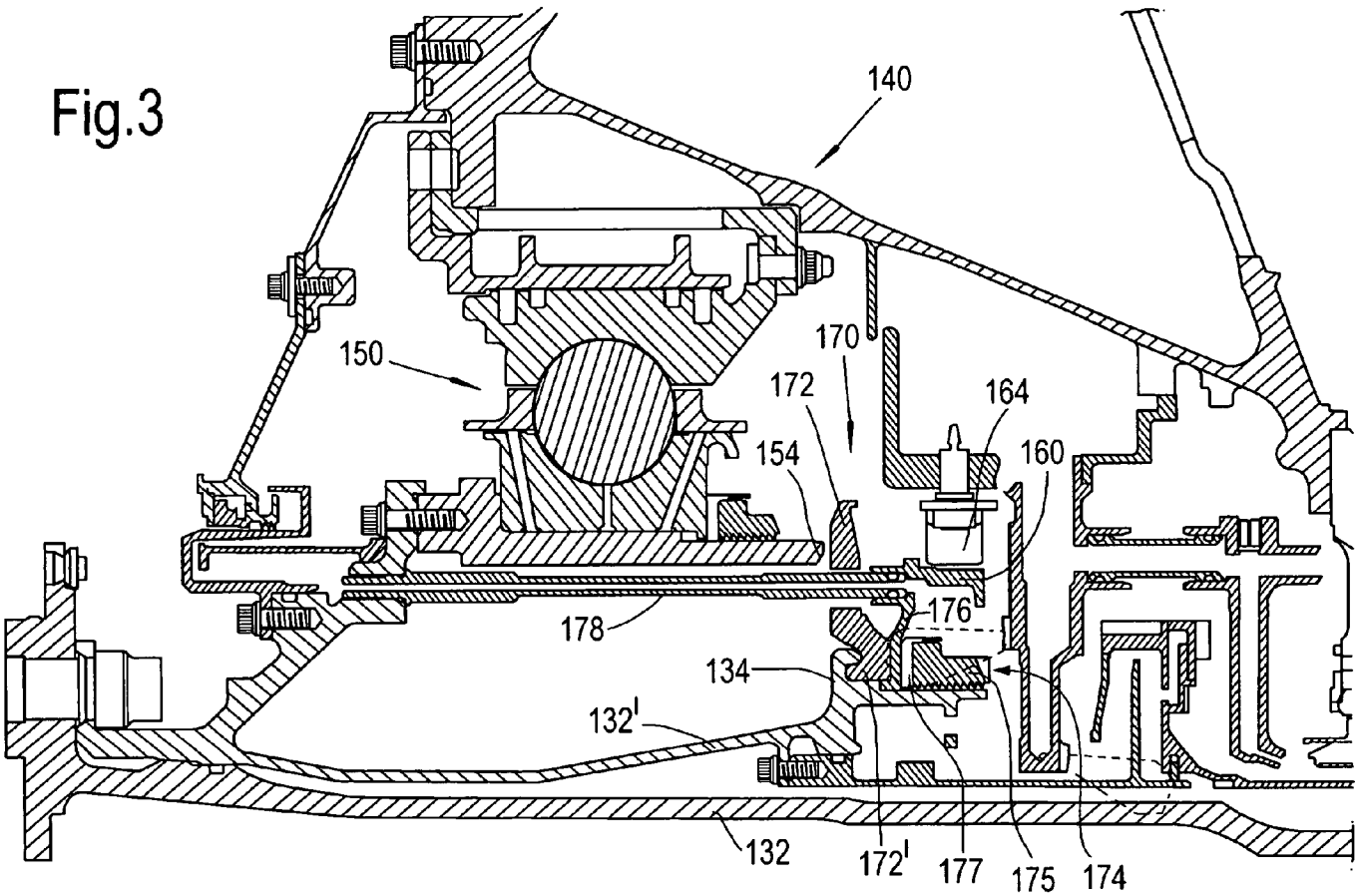
FIG. 3 is a partial sectional view of a front bearing housing comprising a catcher ring assembly according to an example of the present disclosure.
Figure 4:
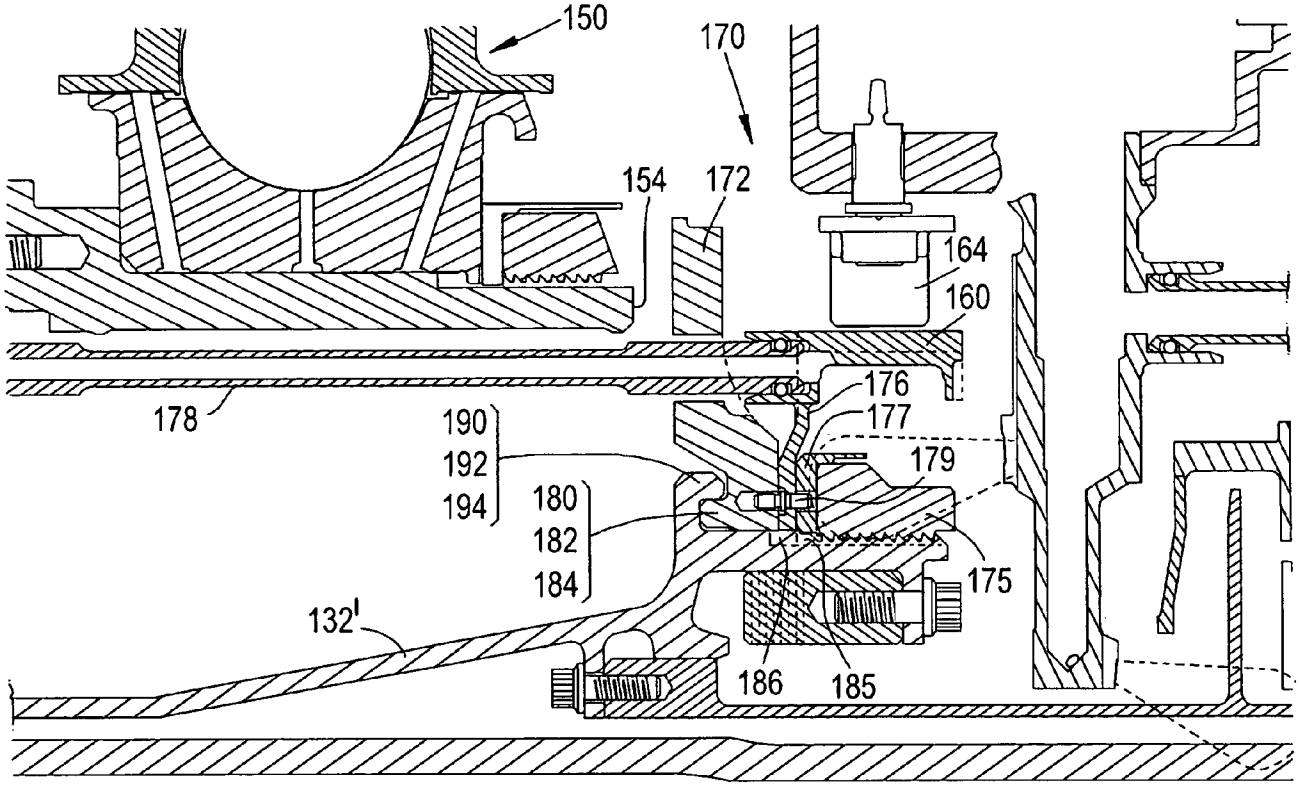
FIG. 4 is a partial sectional view of a catcher ring assembly according to an example of the present disclosure.

With reference to FIG. 3, a front bearing housing 140 according to a first example of the present disclosure comprises a catcher ring assembly 170. The catcher ring assembly 170 comprises a catcher ring 172, which is disposed about and connectable to a shaft assembly 132, 132'. The catcher ring 172 is configured to limit axial movement of the shaft assembly following a failure of the shaft or component attached thereto. In the particular example shown, the shaft assembly may comprise an LP shaft 132 and LP stub shaft 132' of a gas turbine engine, e.g. a jet engine, and the LP shaft may drive a fan (not shown). (Note, FIGS. 3 and 4 are partial sectional views of the front bearing housing 140 and as such only depict parts of components on one side of the longitudinal axis.)

In the event of a fan blade off or failure in the LP shaft, the catcher ring 172 may limit axial movement of the LP shaft to prevent any further damage. The catcher ring 172 may abut a shoulder 154 of the bearing 150 during the failure mode. The shoulder 154 may be part of the LP stub shaft 132' and the resulting reaction load is transmitted through the bearing 150 to the front bearing housing 140.

The catcher ring 172 may comprise an opening for receiving the stub shaft 132'. A portion 172' of the catcher ring 172, e.g. closest to the opening, may be secured between a shoulder 134 of the shaft assembly and a nut assembly 174 comprising a nut 175. The nut 175 may comprise a threaded portion which engages a corresponding threaded portion on the stub shaft 132'. One or more intermediate elements may be provided between the nut 175 and the portion 172' of the catcher ring 172. For example, a first intermediate element may comprise an oil distributer ring 176. A second intermediate element may comprise a washer, e.g. a cup washer 177.

The oil distributer ring 176 may connect to an oil feed tube 178. The oil feed tube may provide the bearing 150 with oil. The oil feed tube 178 may pass through a further opening in the catcher ring 172. A plurality of oil feed tubes 178 may be provided about the circumference of the catcher ring 172.

A portion of a speed measuring device, e.g. a phonic wheel 160, may also be connected to the oil distributer ring 176. As depicted, the portion of the speed measuring device may be integral with the oil distributer ring 176. Alternatively, the portion of the speed measuring device may be a separate component and said portion may be connected to the catcher ring assembly 170 via the nut assembly 174. In a known fashion, the phonic wheel 160 may comprise a series of teeth equiangularly disposed and the teeth may induce a current in an adjacent sensor 164 such that the speed of the phonic wheel 160 and hence shaft 132 may be measured. One or more of the teeth may be omitted to provide a further check on the rotational speed of the shaft 132.

With reference to FIG. 4, which shows the catcher ring assembly in greater detail, the catcher ring 172 may comprise a hook portion 180 at a radially inner position, e.g. closest to the opening of the catcher ring. The hook portion 180 may be adapted to connect to a corresponding hook portion 190 provided on the stub shaft 132'. The hook portions 180, 190 of the catcher ring and/or stub shaft may comprise a protrusion and/or recess. More specifically, the stub shaft 132' may comprise a first recess 192 and the catcher ring 172 may comprise a first protrusion 182. The first recess 192 may at least partially correspond in shape to the first protrusion 182 such that a pivoting movement of the catcher ring 172 with respect to the stub shaft 132' is restricted. In addition or alternatively, the stub shaft 132' may comprise a second protrusion 194 and the catcher ring 172 may comprise a second recess 184. The second recess 184 may at least partially correspond in shape to the second protrusion 194 such that a pivoting movement of the catcher ring 172 with respect to the stub shaft 132' is restricted.

The protrusions and recesses may be axially aligned, e.g. for ease of manufacture and fitting. For example, the protrusions 182, 194 may be orientated in the longitudinal direction and the corresponding recesses 192, 184, which may be configured to receive the protrusions, may be orientated in the longitudinal direction.

One or both of the first and second protrusions 182, 194 and recesses 192, 184 may be circumferentially disposed about a longitudinal axis of the shaft assembly such that they extend about the circumference of the corresponding stub shaft and catcher ring. In other words the protrusions may form annulets, whilst the recesses may be in the form of annular grooves.

Both the first and second protrusions and recesses may be circumferentially disposed, e.g. with the first and second protrusions and recesses extending about the circumference of the corresponding stub shaft and catcher ring. In this case, the catcher ring assembly 170 may further comprise a spline or recess for engagement with a corresponding recess or spline provided on the shaft assembly respectively. The recess and spline may be configured to limit rotation of the catcher ring assembly relative to the shaft assembly.

In the particular example shown in FIG. 4, the second intermediate element 177 may comprise one or more splines 185 which may engage with one or more recesses 186 provided on the stub shaft 132'. The catcher ring assembly 170 may further comprise a locking member 179. The locking member may be disposed between the second intermediate element 177 and the catcher ring 172 to limit rotation of the catcher ring with respect to the second intermediate element 177. The locking member may pass through corresponding openings provided in the catcher ring 172, first intermediate member 176 and/or second intermediate member 177. Accordingly, the locking member 179 and splines 185 may together limit rotation of the catcher ring 172 with respect to the stub shaft 132'.

Alternatively, the catcher ring 172 opening may comprise a spline or recess for engagement with a corresponding and respective recess or spline provided on the stub shaft 132'.

In a further alternative arrangement, the first protrusion 182 and first recess 192 may be circumferentially disposed, whilst the second protrusion 194 and second recess 184 may not be completely circumferentially disposed, e.g. the second protrusion 194 and second recess 184 may not extend about the entire circumference. In this case the second protrusion 194 and second recess 184 may serve to limit rotation of the catcher ring assembly relative to the shaft assembly.

The hook portions 180 and/or 190 stiffen the connection between the catcher ring 172 and stub shaft 132'. This allows the catcher ring 172 to be supported in the circumferential groove formed by recess 192 in the stub shaft 132' such that the catcher ring 172 bends or flexes rather than pivot, heel or precess with respect to the stub shaft 132'. Axial deflection of the catcher ring 172 is thus reduced and damage to the phonic wheel 160 prevented. A signal to the engine controller indicating the rotational speed of the shaft 132 is thus maintained for the required time, thereby allowing a safe shutdown.

Furthermore, separating the direct connection between the phonic wheel and the catcher ring by instead attaching the phonic wheel via the nut assembly, further reduces the effect of the catcher ring distortion on the phonic wheel mount. As a result, the phonic wheel is less likely to be compromised by movement of the catcher ring.

In short, the present application discloses a phonic wheel which is isolated from the fan catcher deformation in such a way that it will not damage or sever the phonic wheel, and which will allow the phonic wheel to continue to monitor the LP stub shaft speed for the prescribed time for a safe shutdown of the fuel system and engine post fan shaft failure.

The invention claimed is:

1. A catcher ring assembly configured to limit axial movement of a turbomachine shaft assembly during a failure mode, the catcher ring assembly comprising:

a catcher ring disposable about and connectable to the shaft assembly, both the catcher ring and the shaft assembly include a protrusion and a recess, the recess of the catcher ring corresponding in shape to the protrusion of the shaft assembly, and the recess of the shaft assembly corresponding in shape to the protrusion of the catcher ring, the protrusions and the recesses being circumferentially disposed about a longitudinal axis of the shaft assembly, and the protrusion of the catcher ring extending away from the catcher ring in an axial direction and the protrusion of the shaft assembly extending away from the shaft assembly in an opposing axial direction, and a nut assembly including an intermediate element and a nut, the intermediate element being provided between the nut and the catcher ring, wherein:

the catcher ring assembly includes a spline or recess for engagement with a corresponding recess or spline provided on the shaft assembly respectively, the recess and spline being configured to limit rotation of the catcher ring assembly relative to the shaft assembly, and the intermediate element includes the spline or recess for engagement with the corresponding recess or spline provided on the shaft assembly respectively.

2. The catcher ring assembly of claim 1, wherein the catcher ring includes the spline or recess for engagement with the corresponding recess or spline provided on the shaft assembly respectively.

3. The catcher ring assembly of claim 1, further comprising a locking member, the locking member being disposable between the intermediate element and the catcher ring to limit rotation of the catcher ring with respect to the intermediate element.

4. The catcher ring assembly of claim 1, wherein the catcher ring is disposed adjacent to a speed measuring device configured to measure the rotational speed of the shaft assembly.

5. The catcher ring assembly of claim 4, wherein at least a portion of the speed measuring device is connected to the catcher ring assembly.

6. The catcher ring assembly of claim 4, wherein at least a portion of the speed measuring device is connected to the catcher ring assembly via said nut assembly.

7. The catcher ring assembly of claim 1, wherein the catcher ring is configured to abut a shoulder to limit axial movement of the shaft assembly during the failure mode.

8. A turbomachine comprising the catcher ring assembly of claim 1.

9. A fan assembly comprising the catcher ring assembly of claim 1.

10. A gas turbine engine comprising the catcher ring assembly of claim 1.

* * * * *